US005269695A

United States Patent [19]

Opel

[11] Patent Number: 5,269,695

[45] Date of Patent: Dec. 14, 1993

[54] ELECTRICAL OUTLET AND PLUG THEREFOR

[75] Inventor: George E. Opel, Ambler, Pa.

[73] Assignee: Geo Ventures, Ambler, Pa.

[21] Appl. No.: 27,298

[22] Filed: Mar. 4, 1993

[51] Int. Cl.[5] ..... H01R 4/66

[52] U.S. Cl. ..... 439/107; 439/654

[58] Field of Search ..... 439/106, 107, 650–659; 174/66; 361/119

[56] References Cited

U.S. PATENT DOCUMENTS

| | | | |
|---|---|---|---|
| 2,861,324 | 11/1958 | Klumpp | 439/106 X |
| 3,441,896 | 4/1969 | Hawkins | 439/107 |
| 5,094,630 | 3/1992 | Jammet | 439/652 |

FOREIGN PATENT DOCUMENTS

| | | | |
|---|---|---|---|
| 1465538 | 5/1969 | Fed. Rep. of Germany | 439/107 |

*Primary Examiner*—Eugene F. Desmond
*Attorney, Agent, or Firm*—Paul & Paul

[57] ABSTRACT

An electrical outlet and plug receivable therein are disclosed. The outlet includes at least one receptacle on its face and at least one receptacle on a side surface thereof. Each receptacle comprises negative, positive and ground openings that are positioned in a straight line. Due to a difference in size between the negative and positive openings, only one orientation of the plug within the receptacle is possible. The outlet may optionally include connectors for the direct connection of electrical cords without the need for plugs and a circuit breaker to prevent overload. The outlet and in-line receptacle configuration allow for additional connections to be made to a single outlet and provide space-saving advantages.

15 Claims, 3 Drawing Sheets

ELECTRICAL OUTLET AND PLUG THEREFOR

FIELD OF THE INVENTION

The present invention relates to a new electrical outlet and a new electrical plug receivable therein. More particularly, the present invention relates to an electrical outlet suitable for mounting on a wall in which the positive, negative and ground openings are positioned in a straight line. The outlet includes such in-line receptacles on both its face and at least one side surface, allowing more connections to be made to a single outlet and also permitting the connection of grounded plugs to the sides of the outlet with minimal intrusion into the room.

BACKGROUND OF THE INVENTION

Both two-prong and three prong electrical connectors are well known. In the past, conventional two-prong connectors have included equally sized positive and negative prongs. More recent two-prong designs include a negative prong that is larger than the positive prong in order to ensure only one orientation of the negative and positive leads within the outlet. Prior art three-prong electrical plugs typically comprise rectangular prongs for the positive and negative leads and a round prong offset from the rectangular prongs for the ground lead. Such three-prong connectors also allow only one orientation of the negative and positive leads.

SUMMARY OF THE INVENTION

It is an object of the present invention to provide a new electrical outlet for receiving grounded electrical plugs.

It is another object of the present invention to provide an electrical outlet having receptacles in which the positive, negative and ground openings allow only one orientation of the positive and negative prongs of an electrical plug.

It is another object of the present invention to provide an electrical outlet that is capable of receiving in-line grounded plugs in both the front and side faces thereof.

It is a further object of the present invention to provide an electrical outlet that is capable of receiving both in-line three prong grounded plugs and conventional plugs of the two-prong and three-prong type.

It is another object of the present invention to provide an electrical outlet in which electrical cords can be connected directly thereto without the use of an electrical plug.

It is a further object of the present invention to provide an electrical outlet that reduces the intrusion of electrical plugs into a room by allowing for connection of the plugs to the side of the outlet rather than to the front face thereof. Placement of receptacles on the side of the outlet, along with the use of an in-line grounded configuration allows for grounded plugs to be connected to the outlet with minimal protrusion from the wall.

Another object of the present invention is to provide a new electrical outlet that includes a circuit breaker and reset button thereon to provide a convenient method of resetting electrical power if the circuit breaker is tripped.

A further object of the present invention is to provide a new in-line electrical plug comprising rectangular positive and negative prongs of differing size and a round grounded prong positioned therebetween.

These and other objects of the present invention will become more readily apparent from the following description.

DESCRIPTION OF THE PREFERRED EMBODIMENT

Figure 1:
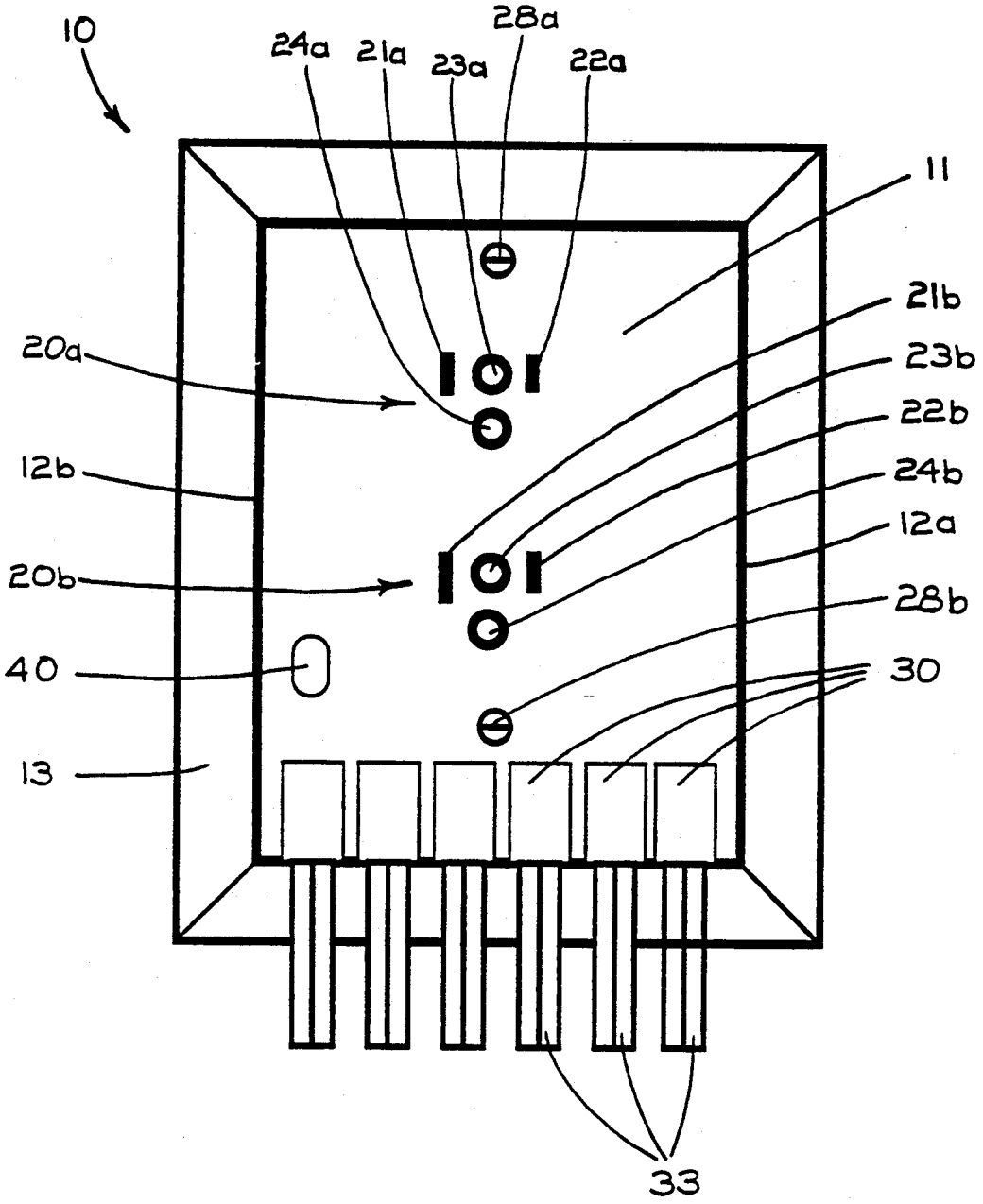
FIG. 1 is a schematic front view of an electrical outlet of the present invention.

Referring to the drawings, wherein like numerals indicate like elements throughout the several figures, there is shown in FIG. 1 a front view of an electrical outlet of the present invention. The outlet 10 includes a face surface 11 that extends in a plane substantially parallel to the surface of a wall upon which the outlet can be mounted. A base surface 11*a*, shown in FIG. 2, contacts the wall on which the outlet is mounted and is parallel to the face surface 11. Side surfaces 12*a* and 12*b* extend in planes substantially perpendicular to the face surface 11 of the outlet. An optional edge guard 13 is provided around the perimeter of the outlet in order to protect the wall surface when the outlet is installed. As shown most clearly in FIG. 2, the edge guard 13 extends from the base edges of the side surfaces toward the wall surface. The face surface 11 includes at least one receptacle thereon and preferably comprises two face receptacles as shown by reference numerals 20*a* and 20*b* in FIG. 1. Each of the face receptacles 20*a* and 20*b* comprises a rectangular negative prong opening 21*a* and 21*b*, a rectangular positive prong opening 22*a* and 22*b* that is smaller in size than the negative prong opening and a circular ground prong opening 23*a* and 23*b* that is located between the negative and positive prong openings. Thus, in each of the face receptacles the negative, positive and ground prong openings are located along a substantially straight line. For example, the face receptacle 20*a* of FIG. 1 comprises the negative prong opening 21*a*, the positive prong opening 22*a* and the ground prong opening 23*a* which are disposed along a straight horizontal line. In the preferred embodiment, a second ground prong opening 24*a* and 24*b* is provided in each face receptacle 20*a* and 20*b*. This second ground prong opening forms a triangle with the negative and positive prong openings in each of the face receptacles. By providing such a second ground prong opening, the outlets of the present invention are adapted to also receive conventional three-prong grounded plugs.

Figure 2:
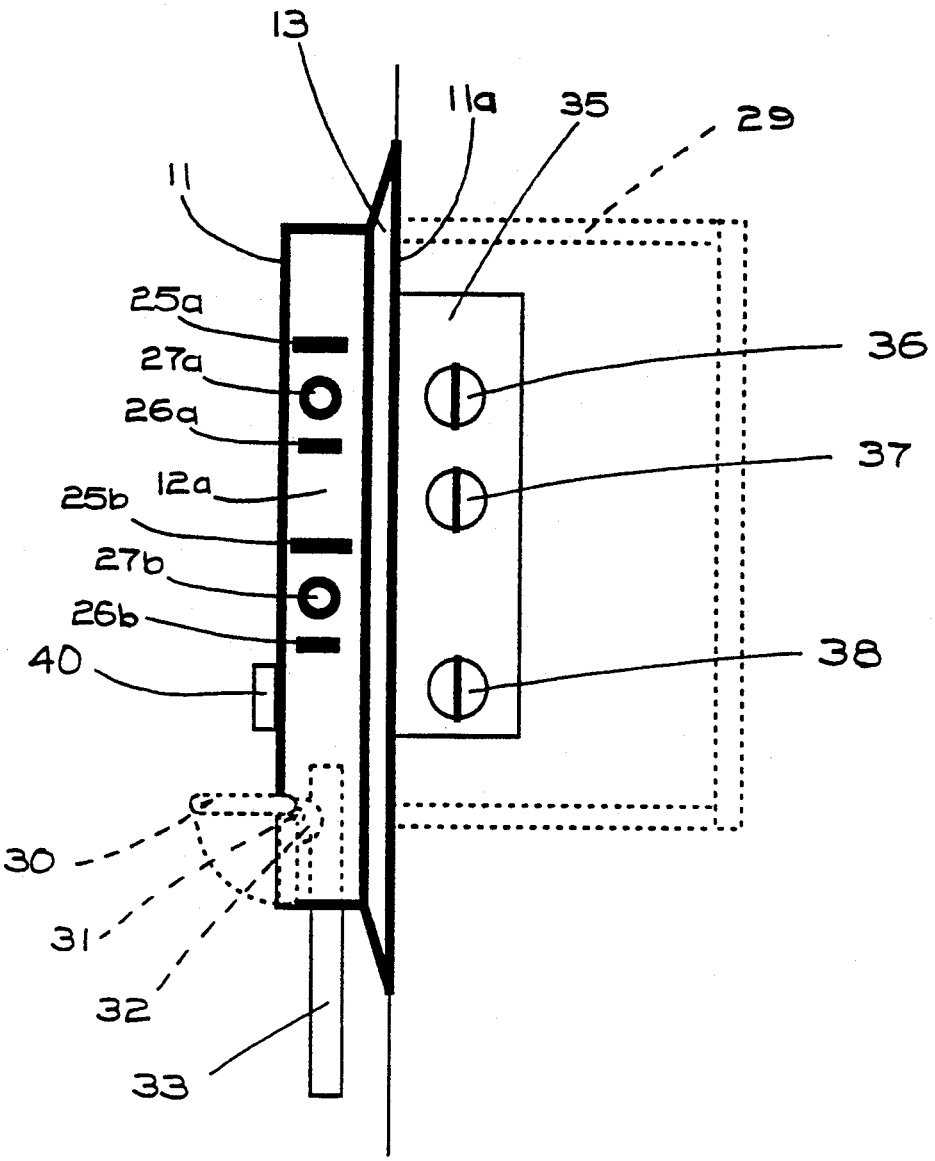
FIG. 2 is a schematic side view of an electrical outlet of the present invention.

The electrical outlet of the present invention also includes at least one side receptacle on a side surface thereof. As shown in FIG. 2, it is preferred to have two side receptacles located on each side surface 12*a*. Each side receptacle includes a rectangular negative prong opening 25*a* and 25*b*, a rectangular positive prong opening 26*a* and 26*b* smaller in size than the negative prong opening and a circular ground prong opening 27*a* and 27*b* located between the negative and positive prong openings. Thus, in each side receptacle the negative, positive and ground prong openings are located in a straight line that runs parallel to the face surface 11 of the outlet. For example, in FIG. 2 negative prong opening 25*a*, positive prong opening 26*a* and ground prong opening 27*a* are disposed along a straight vertical line. This orientation minimizes the distance that the face surface 11 extends from the base of the outlet. Preferably, the distance that the face surface 11 extends from the base surface 11*a* is less than three times the length of the negative prong and more preferably less than two times the length of the negative prong. Thus, as illustrated in FIG. 2, when the base of the outlet is mounted against a wall, the face surface 11 of the outlet protrudes a very small distance from the wall. It is noted that conventional two-prong and grounded three-prong plugs may be received within the side receptacles, although the connection of a conventional three-prong grounded plug would require the grounded prong to be unconnected and to extend across a portion of the face surface 11.

The electrical outlet of the present invention may be installed in a wall or other surface by conventional means such as screws 28*a* and 28*b* as shown in FIG. 1 which are in alignment with the standard hole locations of electrical wall boxes. The present electrical outlet may be connected to a conventional wiring box 29 as shown in FIG. 2. Since the receptacles 20*a* and 20*b* are integrally formed with the outlet, the wires contained within the wiring box are connected directly to the outlet via a member 35 that extends from the back of the outlet into the wiring box 29. The member 35 includes connectors for positive 36, negative 37 and ground 38 leads. Little or no change in electrical wall wiring is necessary with the electrical outlet of the present invention and the outlet may be attached directly to existing wiring boxes. A particular advantage of the present invention is that the outlet can be provided as a one-piece unit in which the base, face and side surfaces and the face and side receptacles are integrally formed as a single component. This one-piece construction essentially eliminates air infiltration that can occur with conventional two-piece electrical outlets, thereby conserving energy. The one-piece unit is preferably made from molded plastic.

In the preferred embodiment of the present invention, the side surfaces 12*a* and 12*b* each comprise two side receptacles, for a total of four side receptacles. These four side receptacles, along with the two face receptacles provide for a total of six electrical receptacles. Additionally, the outlet may be provided with at least one direct electrical connector for connecting an electrical cord directly thereto. Such direct connectors eliminate the need for electrical plugs and provide a neater appearance for the electrical connections made to the outlet. As shown most clearly in FIG. 2, each direct electrical connector includes a lever 30 rotatably connected to the outlet by a pin 31. The direct connector includes a cam member 32 that allows for the insertion of an electrical cord 33 within the outlet while in the open position. When the lever 30 rotates counterclockwise from an open position as shown in FIG. 2 to a closed position, the cam member 32 presses the electrical cord 33 against metallic conductor prongs (not shown) to thereby penetrate the insulation of the electrical cord 33 and to form an electrical connection between the conductive wires of the cord and the metallic conductor prongs. The number of direct connectors provided on a single outlet may vary up to an amount at which overload occurs. As shown in FIG. 1, an outlet with six direct electrical connectors may be provided, each with a separate lever 30 and cam member. Alternatively, a single lever and cam member could replace the individual members in order to provide a neater appearance.

The outlet of the present invention may optionally include a circuit breaker (not shown) of conventional design in order to prevent overloading of the outlet. A reset button 40 may be located on the face surface 11 of the outlet for resetting the circuit breaker once the breaker has been tripped.

Figure 3A:
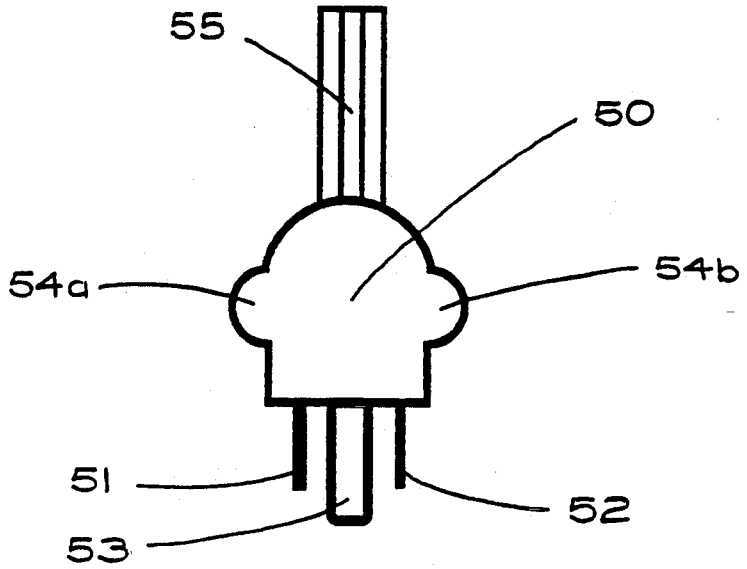
FIG. 3A is a schematic front view of an electrical plug in accordance with the present invention.
Figure 3B:
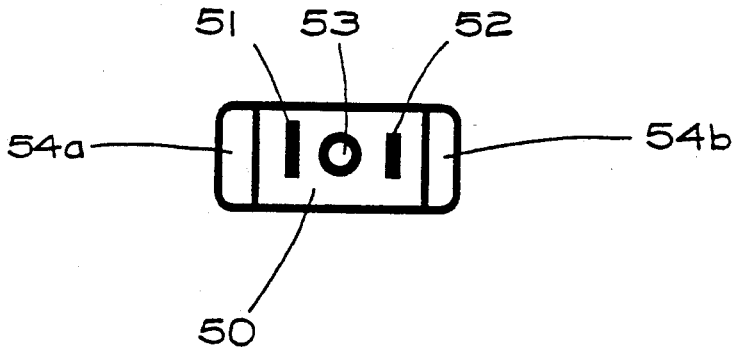
FIG. 3B is a schematic end view of an electrical plug in accordance with the present invention.

FIGS. 3A and 3B illustrate an electrical plug in accordance with the present invention. The plug includes a gripable base member 50 having a negative prong 51, a positive prong 52 and a ground prong 53 extending therefrom. The plug is adapted to be received within the receptacles illustrated in FIGS. 1 and 2. The negative prong 51 and the positive prong 52 are of generally rectangular cross-section, with at least a portion of the negative prong being larger in cross-sectional area than the positive prong. The ground prong 53 has a circular cross-section and is located between the negative prong 51 and the positive prong 52. As shown most clearly in FIG. 4, the negative, positive and ground prongs 51, 52 and 53 are aligned in a straight line on the base member 50. The plug also includes an electrical cord 55 connected thereto comprising three insulated wires that are in electrical connection with the negative, positive and ground prongs. In the preferred embodiment, the base member 50 includes two projections 54*a* and 54*b* extending from opposite sides of the base in a direction substantially parallel to the straight line formed by the negative, positive and ground prongs. A relatively flat grounded plug configuration is therefore provided that saves space, particularly when connected to a side receptacle of the electrical outlet of the present invention.

The electrical outlet and plug of the present invention provide several advantages over conventional designs. The present outlet allows flat three-prong grounded plugs to be plugged into both the front face and side surface of the outlet. When connected to the side receptacle, the plug extends only a short distance from the wall and allows for furniture and other articles to be placed close to the wall in the vicinity of the outlet. Furthermore, the side receptacles accept conventional two-prong flat plugs with the same space-saving benefit. Although not recommended for safety reasons, conventional three-prong grounded plugs can also be connected to the side receptacles, with the grounded plug remaining unconnected. The front receptacles of the present outlet have the advantage that they accept both the new in-line three-prong grounded plugs and conventional offset three-prong grounded plugs. In addition, the front receptacles accept conventional two-prong plugs. Thus, the outlets of the present invention are fully compatible with existing plugs, while also accepting the new in-line three-prong grounded plugs.

The ability to directly connect electrical cords in accordance with the preferred embodiment of the present invention advantageously provides a simple way of making electrical connections which eliminates the need for bulky plugs. This allows for the connection of relatively permanent appliances, such as lamps and the like, wherein the cord length is adjusted to eliminate excess wire, thereby providing a neater appearance and less danger of tripping, etc. The outlet and plug of the present invention provide for more connections to an outlet without adding extension cords or extenders to an outlet, permit furniture to be placed closer to a wall, permit the shortening of wires for neater installations and provide safer areas near the outlet.

It will recognized by those skilled in the art that changes may be made to the above described embodiments of the invention without departing from the broad inventive concepts thereof. It is understood therefore that this invention is not limited to the particular embodiments disclosed, but is intended to cover all modifications which are within the scope and spirit of the invention as defined by the appended claims.

What is claimed is:

1. An electrical outlet adapted for mounting to a wall, the outlet comprising:

a) a base surface adapted for contacting a wall;

b) a face surface extending in a plane substantially parallel to said base surface;

c) at least one face receptacle disposed on said face surface comprising a generally rectangular negative prong opening, a generally rectangular positive prong opening of smaller size than said negative prong opening and a generally circular ground prong opening located between said negative prong opening and said positive prong opening, said negative, positive and ground prong openings being disposed along a substantially straight line;

d) at least one side surface extending in a plane substantially perpendicular to said face surface; and e) at least one side receptacle disposed on said side surface comprising a generally rectangular negative prong opening, a generally rectangular positive prong opening of smaller size than said negative prong opening and a generally circular ground prong opening located between said negative prong opening and said positive prong opening, said negative, positive and ground prong openings being disposed along a substantially straight line that is substantially parallel to the plane of said face surface.

2. An electrical outlet according to claim 1, wherein said outlet comprises a plurality of said face receptacles.

3. An electrical outlet according to claim 1, wherein said at least one face receptacle further comprises a second generally circular ground prong opening that is offset from said substantially straight line formed by said negative, positive and ground prong openings.

4. An electrical outlet according to claim 1, wherein said outlet comprises a plurality of said side receptacles.

5. An electrical outlet according to claim 1, wherein said outlet comprises two of said side surfaces located adjacent to opposing sides of said face surface and extending in substantially parallel planes.

6. An electrical outlet according to claim 5, wherein each of said side surfaces comprises a plurality of said side receptacles.

7. An electrical outlet according to claim 1, wherein the distance said face surface extends from said base surface is less than three times the length of said negative prong opening of said side receptacle.

8. An electrical outlet according to claim 1, wherein the distance said face surface extends from said base surface is less than two times the length of said negative prong opening of said side receptacle.

9. An electrical outlet according to claim 1, wherein said outlet further comprises an edge portion extending from the edge of said at least one side surface toward said base surface and adapted to protect the wall surface when said outlet is mounted thereon.

10. An electrical outlet according to claim 1, wherein said outlet further comprises at least one direct electrical connector adapted to connect an electrical cord directly thereto.

11. An electrical outlet according to claim 10, wherein said direct electrical connector comprises a cam member adapted to rotate into an open position in which said electrical cord can be inserted into said connector and adapted to rotate into a closed position in which said cam member presses said electrical cord against electrically conductive members to form an electrical connection therewith.

12. An electrical outlet according to claim 11, wherein said outlet comprises a plurality of said direct electrical connectors.

13. An electrical outlet according to claim 1, wherein said outlet further comprises an electric circuit breaker.

14. An electrical outlet according to claim 13, wherein said outlet further comprises a reset button disposed on said face surface adapted for resetting said circuit breaker after said circuit breaker has been tripped.

15. An electrical outlet according to claim 1, wherein said base, face and side surfaces and said face and side receptacles are provided as one piece.

* * * * *